US005090736A

United States Patent [19]

Minkus

[11] Patent Number: 5,090,736

[45] Date of Patent: Feb. 25, 1992

[54] MULTI-SHEET LAMINATED IDENTIFICATION CARD WITH TAMPER RESISTANT, ULTRASONIC WELDMENTS

[75] Inventor: Morton Minkus, Winnetka, Ill.

[73] Assignee: Transilwrap Company, Inc., Chicago, Ill.

[21] Appl. No.: 646,820

[22] Filed: Jan. 28, 1991

[51] Int. Cl.[5] ..... B42D 15/00

[52] U.S. Cl. ..... 283/77; 283/107; 283/904; 283/108

[58] Field of Search ..... 283/77, 107, 108, 109, 283/904

[56] References Cited

U.S. PATENT DOCUMENTS

| | | | |
|---|---|---|---|
| 2,712,514 | 7/1955 | English, Jr. | 283/904 |
| 3,279,826 | 10/1966 | Rudershausen et al. | 283/904 |
| 3,631,617 | 1/1972 | Pekko | 283/108 X |
| 4,057,919 | 11/1977 | Gauch et al. | 283/108 |
| 4,070,774 | 1/1978 | Staats et al. | 283/77 X |
| 4,096,015 | 6/1978 | Kawamata et al. | 283/108 X |
| 4,298,217 | 11/1981 | Moraw et al. | 283/77 X |
| 4,318,554 | 3/1982 | Anderson et al. | 283/77 X |
| 4,441,945 | 4/1984 | Moraw et al. | 283/107 X |
| 4,455,359 | 6/1984 | Patzold et al. | 283/108 X |
| 4,456,639 | 6/1984 | Drower et al. | 283/107 X |
| 4,557,963 | 12/1985 | Caines | 283/107 X |
| 4,589,687 | 5/1986 | Hannon | 283/77 X |
| 4,710,617 | 12/1987 | Mouchotte | 283/77 X |
| 5,002,312 | 3/1991 | Phillips et al. | 283/77 X |

*Primary Examiner*—Paul A. Bell
*Attorney, Agent, or Firm*—Kinzer, Plyer, Dorn, McEachran & Jambor

[57] ABSTRACT

An identification card of the kind including at least two and usually three resin sheets bonded together, with identification data at an interface between sheets visible through the outermost sheet, which is transparent, and incorporates added anti-tampering protection in the form of a band or other limited area weldment between the sheets usually formed by an ultrasonic weldment; the weldment is clearly visible due to surface distortion caused by it but is not so extensive as to prevent effective viewing of the identification data in its limited area. In a more particularized aspect of the invention, a portion of the identification data is more significant than the remainder of the data and thus more susceptible to being tampered with and the weldments are placed in this susceptible area of the identification data.

10 Claims, 1 Drawing Sheet

MULTI-SHEET LAMINATED IDENTIFICATION CARD WITH TAMPER RESISTANT, ULTRASONIC WELDMENTS

BACKGROUND OF THE INVENTION

This invention relates to an identification card of the kind including at least two and usually three, but sometimes more, resin sheets bonded together with identification data located at an interface between the sheets. In the past, the identification data has been carried on a separate sheet of paper, but through the use of modern technology involving computers and computer controlled color printers, identification data including photographs can be printed in color directly on one of the sheets of resin forming a part of the laminated card. In order that the identification data be visible, the outermost sheets or sheets on at least one side of the card are formed of transparent material.

Identification cards must be easy and inexpensive to manufacture, preferably using readily available equipment by unskilled operators. However, the cards must be durable and essentially tamper resistant to be trustworthy. These requirements are often difficult to meet. Materials that are susceptible to heat and pressure sealing, and, therefore, easy and inexpensive to laminate, often lack durability and can be readily separated by the application of heat and/or solvents in conjunction with physical manipulation. Anti-tampering features such as the use of coatings that are only visible under special lighting add to the complexity of the manufacturing process and, therefore, the expense of manufacturing such identification cards. The reliance on such coatings also necessitates the use of special equipment to determine if a card has been tampered with.

SUMMARY OF THE INVENTION

Thus, an object of this invention is a multi-sheet, laminated identification card having limited area weldments between the sheets in the form of a band or bands which render the identification card virtually tamper resistant.

Another object of this invention is a multi-sheet, laminated identification card having weldments of limited area in the form of bands, which weldments are visible to the ordinary observer but do not obscure the identification data.

A further object of this invention is a multi-sheet, laminated identification card having identification data located at an interface between the sheets in which a portion of the identification data in a limited area is more significant than the identification data in the remainder of the identification data area with the weldments being located such as to protect the portion of more significant data.

Yet another object of this invention is a multi-sheet, laminated identification card having tamper resistant weldments which are ultrasonically formed.

Accordingly, the invention relates to an identification card of the kind including a plurality of sheets of predetermined dimensions, configuration and area, totally secured to one another in flat, surface-to-surface configurations. One of the sheets bears identification data on one of its surfaces that engages another sheet. Any sheets outwardly of the identification data in at least one direction are made of transparent material so that the identification can be seen therethrough. The improvement of this invention includes a tamper resistant weldment bonding the plurality of sheets together in a given weldment area which is substantially smaller than the total area of the identification data. The tamper resistant weldment is of a type that is clearly visible due to surface distortment caused by the presence of the weldment, with the surface distortment not precluding effective inspection of the identification data in the weldment area.

DESCRIPTION OF THE PREFERRED EMBODIMENT

Figure 1:
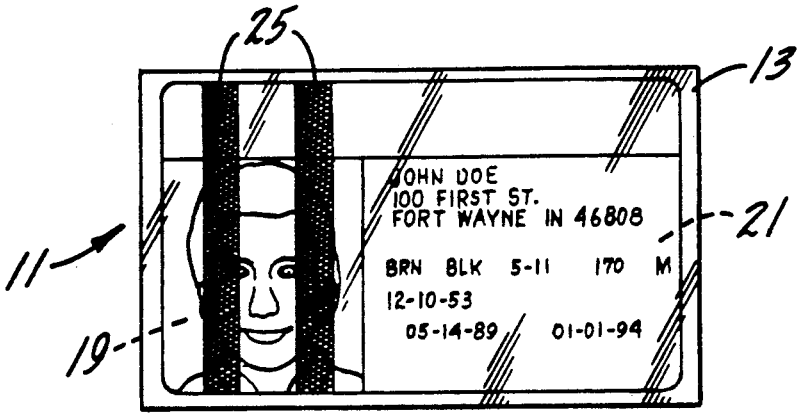
FIG. 1 is a plan view of a laminated identification card constructed in accordance with the teachings of this invention.
Figure 2:
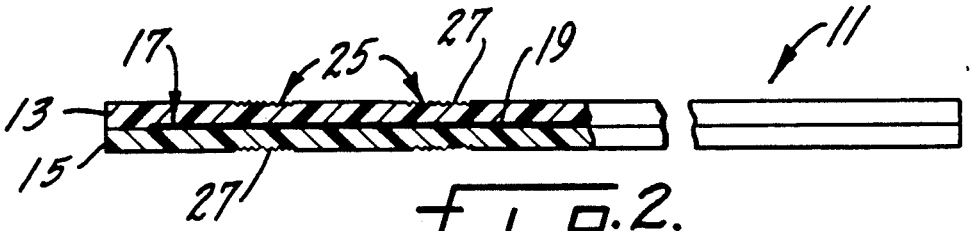
FIG. 2 is an enlarged, side elevational view of an identification card of one embodiment of the invention with a portion of the identification card shown in cross-section.

FIGS. 1 and 2 of the drawings show an identification card 11 made in accordance with the one embodiment of the teachings of this invention. Such a card includes a plurality, in this case two sheets 13 and 15, of predetermined dimensions, configuration and area, which are generally rectangular in shape with the sheets totally secured to each other in flat, surface-to-surface configuration. At an interface between the sheets 13 and 15, identification data 17 is provided. This data may be applied to a separate sheet of paper but, as is more common today, it is applied to a surface of one of the sheets, in this case the lower sheet 15, by printing, for example, from a computer-controlled, multi-colored printer. Such identification data can include a photograph 19 in one area and letters and numerals 21 in another area of the sheet 15. The photograph 19 is considered a more significant piece of identification data and is more susceptible to being tampered with for this reason.

Conventionally, what is the upper sheet 13 of the card 11 is formed of an oriented polyester while the lower sheet 15 is formed of an amorphous polyester. Preferably, the oriented polyester is an oriented polyethylene terephthalate and the amorphous polyester is amorphous polyethylene terephthalate. These sheets are conventionally used in identification cards because the oriented polyester is hard and tough, while the amorphous polyester is heat and pressure sealable. The sealing can be accomplished by passing the sheets through heated rollers at a temperature above 300° F.

In order to render the laminant shown in FIG. 2 tamper resistant, ultrasonic weldments 25 are applied to the laminated card 11. In this example, two weldments 25 are applied to extend across the width of the card in the area containing the photograph 19. The weldments create surface distortion 27 which are visible to a viewer but do not distort the photograph to such an extent that it is not recognizable by a viewer. The weldment 25 bonds together both of the sheets 13 and 15 in such engagement that they cannot be separated without virtual destruction of the material of the sheets. Further, an attempt to break the weldments will change the surface distortion 27 in the area of the photograph 19, thereby clearly indicating to a viewer that at least the photographic area 19 of the identification data 17 has been changed or manipulated.

Whereas, the example shown herein has two ultrasonic weldments extending across the width of the card, it should be understood and appreciated that more than two bands of weldments may be provided and the weldments may be spaced across the entire surface of the identification card 11. The ultrasonic welds can be made with conventional ultrasonic welding equipment such as those of the type manufactured and sold by Branson Ultrasonics Corporation of Danbury, Conn. These ultrasonic welding machines operate at frequencies of 20 and 40 kHz frequencies.

Figure 3:
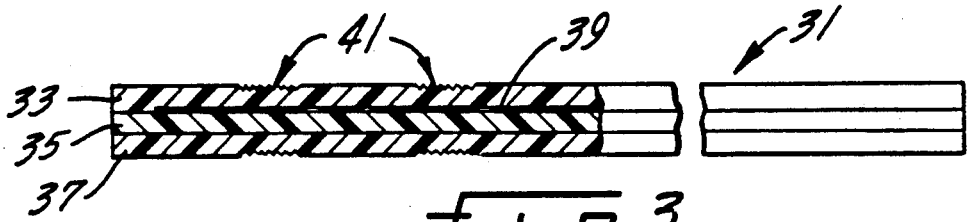
FIG. 3 is an enlarged, side elevational view of an identification card of another embodiment of the invention with a portion of the identification card shown in cross-section.

A modified form of the invention is shown in FIG. 3 of the drawings. In this modified form of the invention, an identification card 31 is formed of sheets 33, 35 and 37. Sheets 33 and 35 are oriented polyesters, while sheet 37 is an amorphous polyester. The identification data 39 is applied to one surface of the sheet 35. The identification data may also contain an area for a photograph 19 and another area for letters and numerals 21, in the same manner as shown in card 11 of FIG. 1. Ultrasonic weldments 41 bond the three sheets together to provide surface distortions similar to surface distortions 27 which would indicate if the ultrasonic weldments are broken or tampered with.

Figure 4:
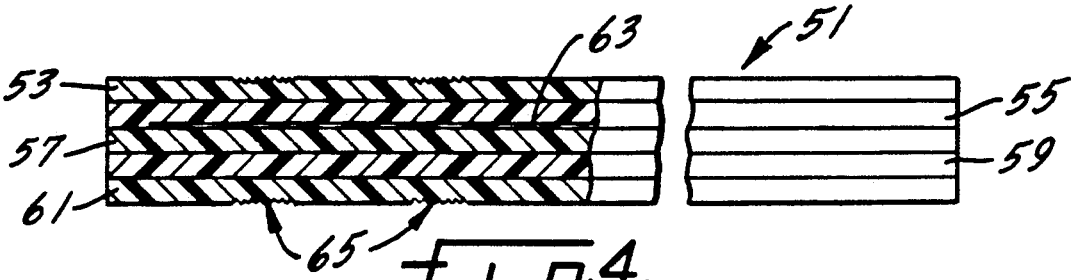
FIG. 4 is an enlarged side elevational view of an identification card of yet another embodiment of the invention with a portion of the identification card shown in cross-section.

Another embodiment of the invention is shown in identification card 51 depicted in FIG. 4 of the drawings. Card 51 is formed of sheets 53, 55, 57, 59 and 61 which are formed by heat and pressure into flat, surface-to-surface engagement with one another. In this embodiment of the invention, sheets 55 and 59 are formed of an oriented polyester and sheets 53, 57 and 61 are formed of an amorphous polyester. As in the previous identification cards, the oriented polyester is oriented polyethylene terephthalate and the amorphous polyester is amorphous polyethylene terephthalate. Identification data 63, printed similar to identification data 17, is printed on one surface of the sheet 57 so that it can be visible through the sheets 53 and 55. Ultrasonic weldments 65 are created in the sheets to bond them together in a tamper resistant manner. As previously described, these weldments create surface distortion in the photographic area of the identification data but do not preclude effective inspection of the identification data in the weldment area.

I claim:

1. In an identification card of the kind comprising first and second sheets of predetermined dimensions, configuration and area, totally secured to each other is flat, surface-to-surface configuration, one of the sheets bearing identification data on its surface that engages the other sheet, and one of the sheets being transparent so that the identification data can be seen therethrough, the improvement comprising:

a tamper resilient weldment, binding the two sheets together in a given weldment area substantially smaller than the total area, such that the tamper resistant weldment is clearly visible due to surface distortion caused by the presence of the tamper resistant weldment with said surface distortion not precluding effective inspection of the identification data in said weldment area.

2. The identification card of claim 1 in which said tamper resistant weldment is an ultrasonically created weldment.

3. The identification card of claim 2 in which said first sheet is formed of oriented polyester and said second sheet is formed of amorphous polyester.

4. The identification card of claim 3 in which said oriented polyester is an oriented polyethylene terephthalate and said amorphous polyester is amorphous polyethylene terephthalate.

5. The identification card of claim 1 further including a third sheet of predetermined dimensions, configuration and area, totally secured to one of said first and second sheets in flat, surface-to-surface configuration with said tamper resistant weldment bonding the three sheets together.

6. In an identification card of the kind including a plurality of sheets of predetermined dimensions, configuration and area, totally secured to one another in flat, surface-to-surface configuration, one of said sheets bearing identification data on one of its surfaces that engages another sheet, said sheets outwardly of said identification data in at least one direction being transparent so that the identification data can be seen therethrough, the improvement comprising:

a tamper resistant weldment, bonding the plurality of sheets together in a given weldment area substantially smaller than the total area, such that the tamper resistant weldment is clearly visible due to surface distortment caused by the presence of the tamper resistant weldment with the surface distortment not precluding effective inspection of identification data in said weldment area.

7. The identification card of claim 6 in which said tamper resistant weldment is an ultrasonically created weldment.

8. The identification card of claim 7 in which at least one sheet of said sheets is formed of an oriented polyester and an adjacent sheet is formed of an amorphous polyester.

9. The identification card of claim 8 in which at least one sheet of said sheets is formed of an oriented polyethylene terephthalate and an adjacent sheet is formed of an amorphous polyethylene terephthalate.

10. The identification card of claim 7 in which identification data has a significant critical portion in a defined area smaller than the area occupied by all of the identification data and said tamper resistant weldment is located in the defined area of said significant critical portion.

* * * * *